US005606827A

United States Patent [19]

Kanou et al.

[11] Patent Number: 5,606,827

[45] Date of Patent: Mar. 4, 1997

[54] WIRE TYPE WINDOW REGULATOR

[75] Inventors: Wataru Kanou; Takahiro Yamada, both of Toyohashi, Japan

[73] Assignee: Asmo Co., Ltd., Kosai, Japan

[21] Appl. No.: 456,921

[22] Filed: Jun. 1, 1995

[30] Foreign Application Priority Data

Oct. 19, 1994 [JP] Japan ..... 6-281219

[51] Int. Cl.[6] ..... E05F 11/48

[52] U.S. Cl. ..... 49/352

[58] Field of Search ..... 49/352, 348; 79/505, 79/502.6, 606 R; 242/388.5, 388.1

[56] References Cited

U.S. PATENT DOCUMENTS

| | | | |
|---|---|---|---|
| 4,970,911 | 11/1990 | Ujihara et al. | 49/352 X |
| 5,109,725 | 5/1992 | Roth et al. | 74/505 |
| 5,367,827 | 11/1994 | Tajima et al. | 49/352 |

FOREIGN PATENT DOCUMENTS

| | | | |
|---|---|---|---|
| 2803807 | 8/1979 | Germany | 49/352 |
| 1-148486 | 10/1989 | Japan . | |
| 2-9285 | 1/1990 | Japan . | |

*Primary Examiner*—Kenneth J. Dorner
*Assistant Examiner*—Jerry Redman
*Attorney, Agent, or Firm*—Oblon, Spivak, McClelland, Maier & Neustadt, P.C.

[57] ABSTRACT

A wire type window regulator is provided wherein dislodging of a wire guide from a motor housing and damage to the motor housing and rewire guide can be prevented. In addition, the angle and length of guide portions of the wire guide are not restricted. The motor housing includes a drum casing wall internally containing a take-up drum. The wire guide has an attachment member filling a cutout portion of the drum casing wall and attaching the wire guide with the motor housing. A step is provided in the drum casing wall and a cooperating protruding portion is provided in the attachment member of the wire guide, thereby preventing the wire guide from being dislodged.

18 Claims, 9 Drawing Sheets

WIRE TYPE WINDOW REGULATOR

BACKGROUND OF THE INVENTION

1. Field of the Invention

The present invention relates to a wire type window regulator.

2. Discussion of the Background

Examples of wire type window regulators using endless wires for raising and lowering automobile windows are previously known, such as disclosed in Japanese Utility Model Application Laid-Open Nos. 1-148486 and 2-9285.

FIG. 8 indicates a conventional wire type window regulator and FIG. 9 is an enlarged exploded view of a part thereof shown in FIG. 8. As shown in FIG. 8, an endless wire 102 is taken up and delivered by a take-up drum 106 in a drive section 104. The endless wire 102 is attached to a window glass supporting member 108, and raises and lowers the window glass supporting member 108 along a guide rail 110. A window glass (not shown) attached to the window glass supporting member 108 is thereby raised and lowered.

In the path from pulleys 112, disposed respectively at the top and bottom ends of the guide rail 110, to the drive section 104, the endless wire 102 passes through tubes 114. One end of each wire tube 114 is inserted in a guide portion 116*a* of a wire guide 116 of the drive section 104, and is pressed toward the releasing direction and given an arc shape by a spring 118 (see FIG. 9) compressed to less than natural length.

By giving the tube 114 an arc shape, slacking of the endless wire 102 can be avoided to prevent idle turning of the take-up drum 106.

However, in the case of a conventional wire type window regulator of this type, when the window glass supporting member 108 stops at the very top or very bottom, a large mechanical shock is imparted to guide portions 116*a* of the drive section 104.

For example, as the take-up drum 106 is driven and raises the window glass supporting member 108, when the window glass supporting member 108 reaches the uppermost position (i.e. window closed state), even though the window glass supporting member 108 cannot be raised further, the take-up drum 106 continues to turn. As a result, since the upper side of the endless wire 112 continues to be pulled and taken up, the tube 114 is straightened, as shown in FIG. 8.

On the other hand, since the endless wire 102 of the bottom side continues to be delivered from the take-up drum 106, force is applied to the tube 114 to have more curvature.

As a consequence, a large mechanical shock from the tubes 114 is imparted to the guide portions 116*a* of the drive section 104. Also, as indicated in FIG. 9, each the wire guides 116 includes a U-shaped attaching portion 117 used to attach the wire guide 116 to a housing 120 containing the take-up drum 106. The above mentioned mechanical shock may dislodge the wire guide 116. In addition, increasing the strength of the attaching portion 117 of the wire guide 116 may cause breakage of the attaching portion 122 of the housing 120.

Furthermore, since the above mentioned mechanical shock is additionally increased when an angle between one guide portion 116*a* and the other guide portion 116*a* is increased, the guide portions 116*a* have to be designed to have a smaller angle. As the shock is also increased when the guide portions 116*a* are longer, the guide portions 116*a* have to be designed so as to be shorter.

SUMMARY OF THE INVENTION

In order to resolve the above mentioned problems, the present invention provides a wire type window regulator wherein dislodging of the wire guide from the motor housing and breakage of the motor housing and wire guide are prevented, and the angle between a pair of guide portions and the lengths of the guide portions are not restricted.

In order to achieve the above mentioned objectives, a wire type window regulator is provided according to the present invention wherein a window glass supporting member secured to an endless wire is moved by taking up the endless wire with a take-up drum which turns in response to a motor, wherein the regulator comprises:

a drum casing wall which has a substantially cylindrical shape and a cutout portion wherein the wall is formed in a motor housing for internally containing the take-up drum; and a wire guide comprising an attachment member which fills the cutout portion in the drum casing wall and contacts at least either an inner surface or an outer surface of the drum casing wall to be attached to the motor housing, and guide portions which extend from the attachment member and guide the endless wire; wherein an engaging portion is provided in a direction of wall thickness of the drum casing wall at the inner surface or the outer surface which contacts the attachment member of the wire guide; and wherein a receiving portion is provided in the attachment member of the wire guide to engage with the engaging portions.

According to this invention, essentially, wire guide dislodging is prevented by forming an engaging portion in a direction of the wall thickness of the drum casing wall.

In other words, the attachment between the motor housing and the wire guide is performed by attaching the attachment member of the wire guide at the cutout portion formed in the drum casing wall of the motor housing. In addition, this attachment member contacts at least either the inner or outer surface of the drum casing wall. An engaging portion and a receiving portion are formed at the mutually contacting position between the drum casing wall and attachment member, and engage each other for attachment.

The engaging portion in the drum casing wall is formed in the wall thickness direction, and the receiving portion engages with the engaging portion. Consequently, the engaged engaging portion and receiving portion are difficult to dislodge in the direction perpendicular to the wall thickness direction of the drum casing wall. This perpendicular direction with respect to the wall thickness direction is the circumferential direction of the substantially cylindrical drum casing wall, namely the direction in which shocks are easily imparted to the guide portions of the wire guide during the endless wire drive (See Description of the Related Art).

As a result of attaching the wire guide to the motor housing, the guide portions of the wire guide can be made resistant to applied shock, and wire guide dislodging can be prevented.

According to this invention, at least one pair of engaging portions is provided at both ends of the cutout portion of the drum casing wall to have an angle greater than a semi-circle on the side of the cutout portion.

Also, according to this invention, a pair of engaging portions of the drum casing wall is formed to have an angle greater than a semi-circle (more than $\pi$ radians) on the cutout portion side. The receiving portions are correspondingly formed in the attachment member of the wire guide to have at an angle greater than semi-circle.

Consequently, since the engaging portions and receiving portions engage at an angle more than a semi-circle, the dislodging of the wire guide from the motor housing in the circumference direction can be more effectively prevented except for the case of deformation of the motor housing and wire guide.

A preferred embodiment of this invention also comprises a limiting wall disposed at the outside of the cutout portion of the drum casing wall in the motor housing for preventing dislodging of the wire guide from the drum casing wall. This limiting wall serves to further prevent dislodging.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

Figure 1:
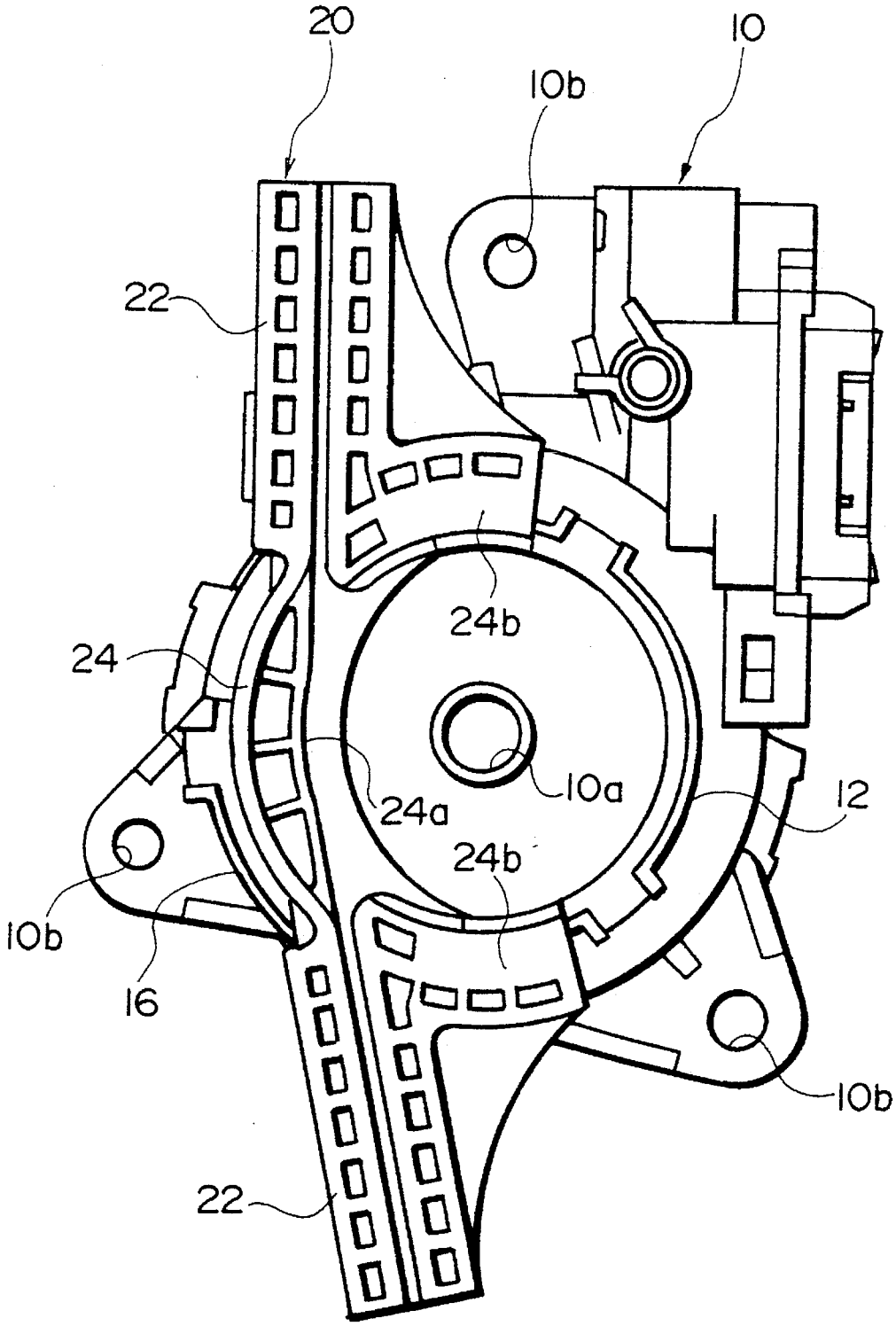
FIG. 1 indicates a wire guide attached to a motor housing of a wire type window regulator of the embodiment.
Figure 2:
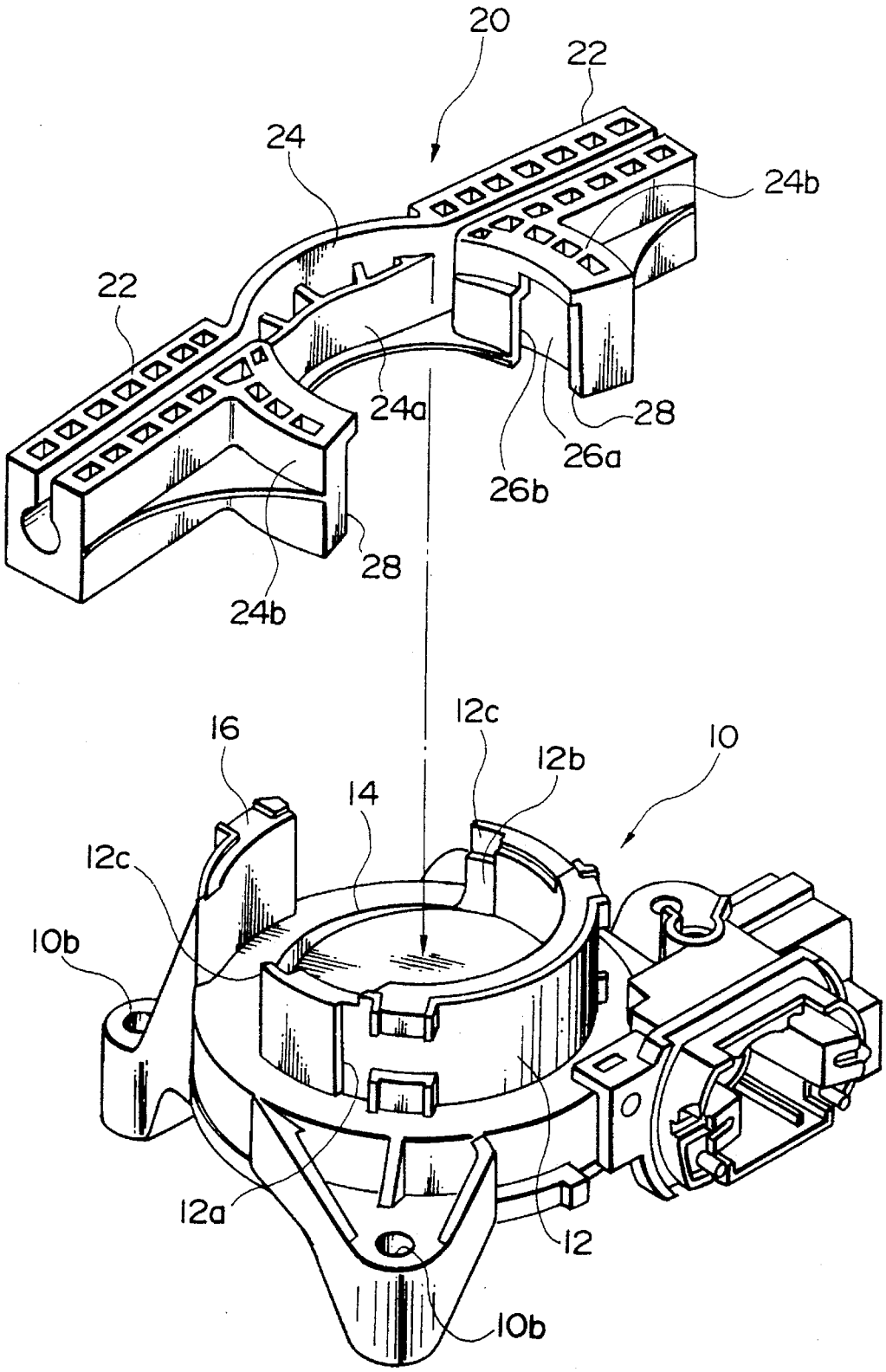
FIG. 2 is an exploded perspective view of FIG. 1.

FIG. 1 shows a wire guide attached to the motor housing of a window regulator. FIG. 2 is an exploded perspective view of FIG. 1.

Figure 8:
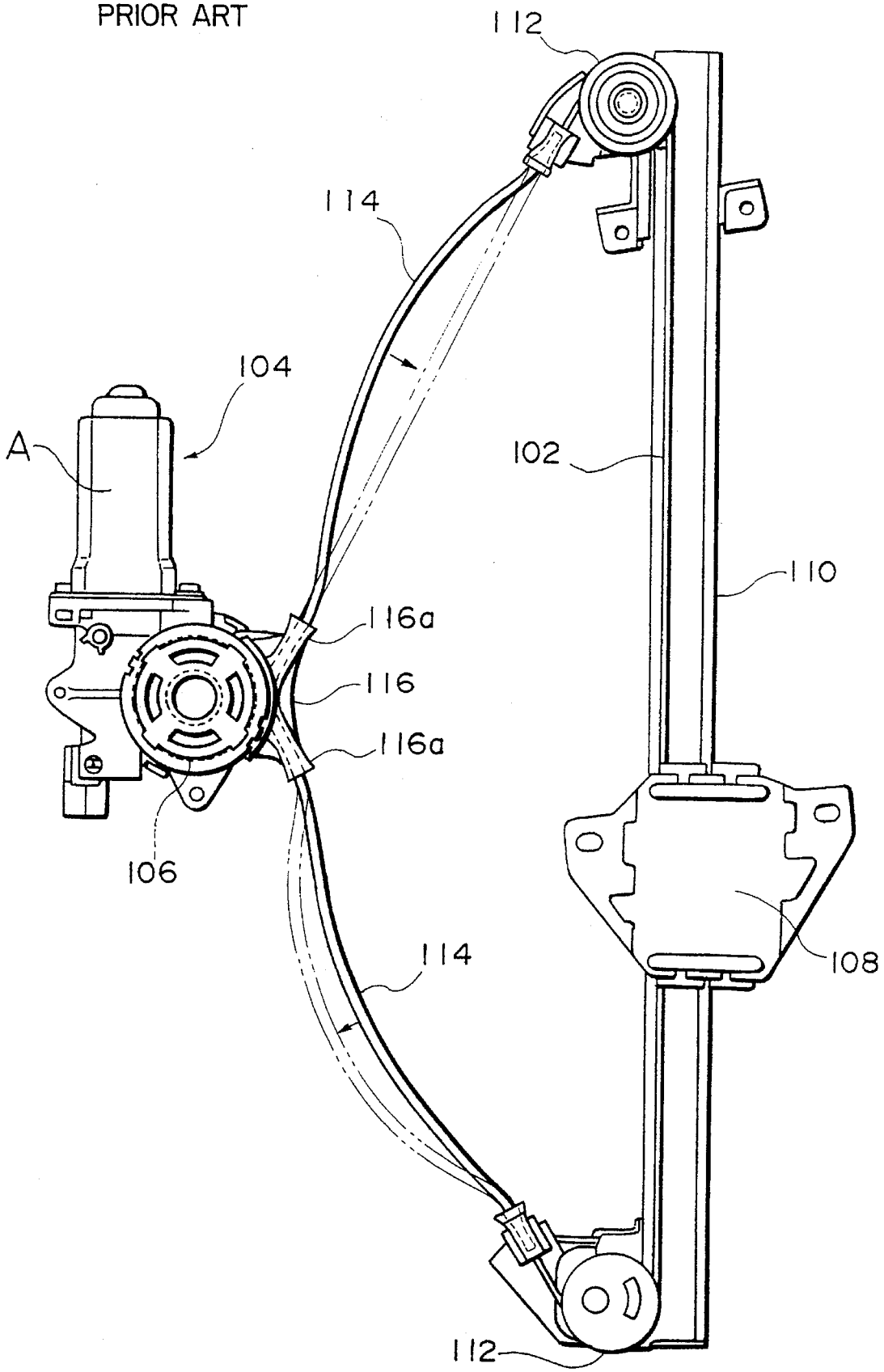
FIG. 8 PRIOR ART
FIG. 8 indicates a conventional wire type window regulator.

The present embodiment relates in particular to the motor housing and wire guide of the window regulator. Construction of elements other than these sections is the same as the window regulator shown in FIG. 8 and a description is omitted below. Also, the window regulator according to this embodiment is used for raising and lowering the window of an automobile.

In FIGS. 1 and 2, the motor housing 10 is a part of a drive section (see 104 in FIG. 8) driving an endless wire, the upper part containing a take-up drum (see 106 in FIG. 8), and the lower part covering a casing for a gear (not shown) which transmits rotational power from a motor (not shown). The power turns the take-up drum through an output shaft (not shown) in a shaft hole 10*a*. A plurality of holes 10*b* are formed for securing the motor housing 10 to the automobile by bolts.

Figure 3:
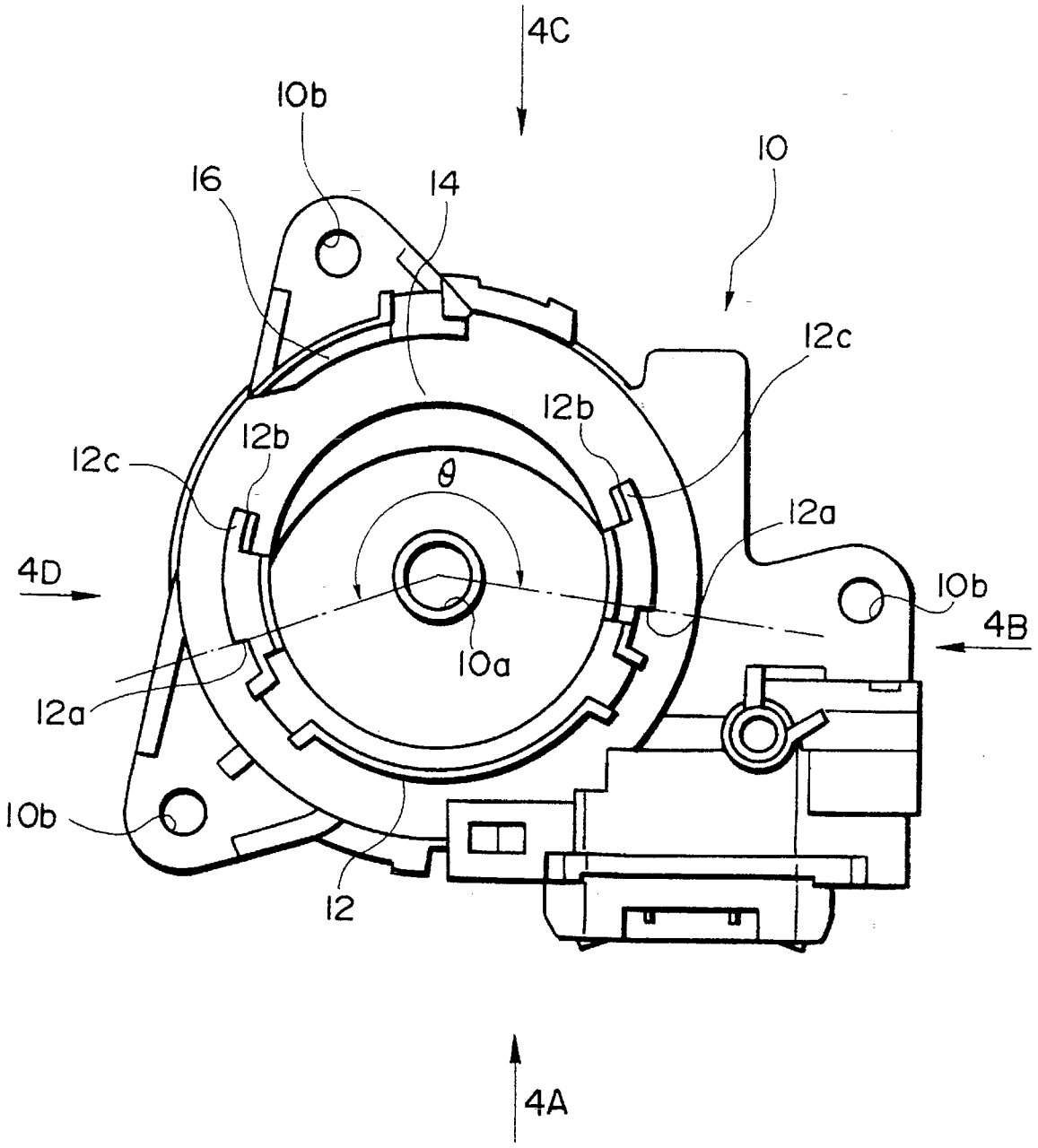
FIG. 3 is a plan view of the motor housing of FIG. 1.
Figure 4B:
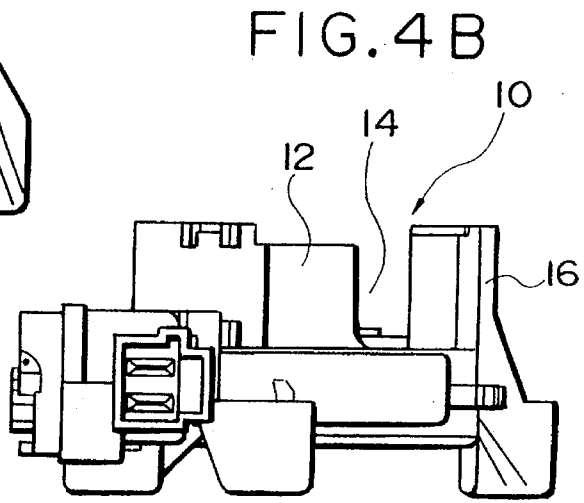
FIGS. 4A–4D are lateral views of the motor housing of FIG. 1.
Figure 4C:
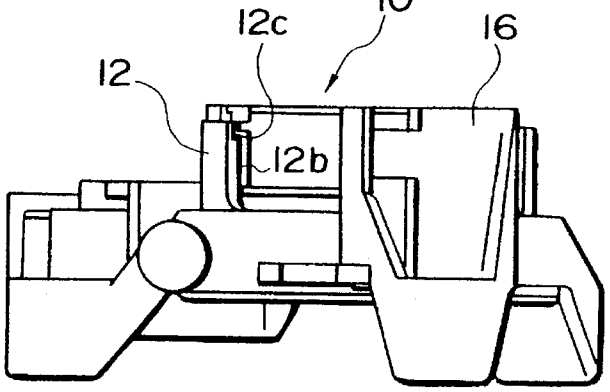
Figure 4A:
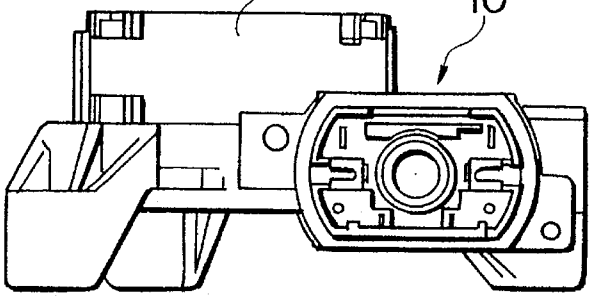
Figure 4D:
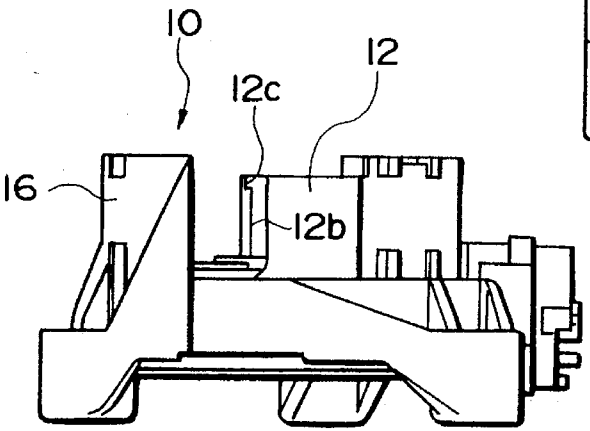

FIG. 3 is a plan view of the motor housing 10 and FIGS. 4A–4D are lateral views of the motor housing 10. In particular, FIG. 4A is a lateral view taken in direction A, FIG. 4B is taken in direction B, FIG. 4C is taken in direction C and FIG. 4D is taken in direction D; respectively, in FIG. 3.

As shown in the figures, a drum casing wall 12 is provided in the motor housing 10. The drum casing wall 12 contains the take-up drum (not shown in the figures) and is therefore curved so as to have a cylindrical shape corresponding to the take-up drum. However, since the drum casing wall 12 has a cutout portion 14, the drum casing wall 12 is thus not a perfect cylinder, but rather is C shaped.

Steps 12*a* are formed in the drum casing wall 12 at positions somewhat close to both ends.

The steps 12*a* are formed in the direction of the wall thickness, in other words, the diameter direction of the drum casing wall 12.

The steps 12*a* serve to prevent dislodging of a wire guide 20. As shown in FIG. 3, the angle formed by the steps 12*a* on the cutout portion 14 side is greater than a semicircle, thereby providing further strength against dislodging of the wire guide 20.

Thin wall portions 12*b* are formed at the respective ends of the drum casing wall 12. The upper parts 12*c* of the thin wall portions 12*b* are formed still thinner than the thin wall portions 12*b*.

A limiting wall 16 is formed in the motor housing 10 on the outside of the cutout portion 14 and is spaced from wall 12. The limiting wall 16 serves to prevent dislodging of the wire guide 20 (see FIG. 1)

Figure 5A:
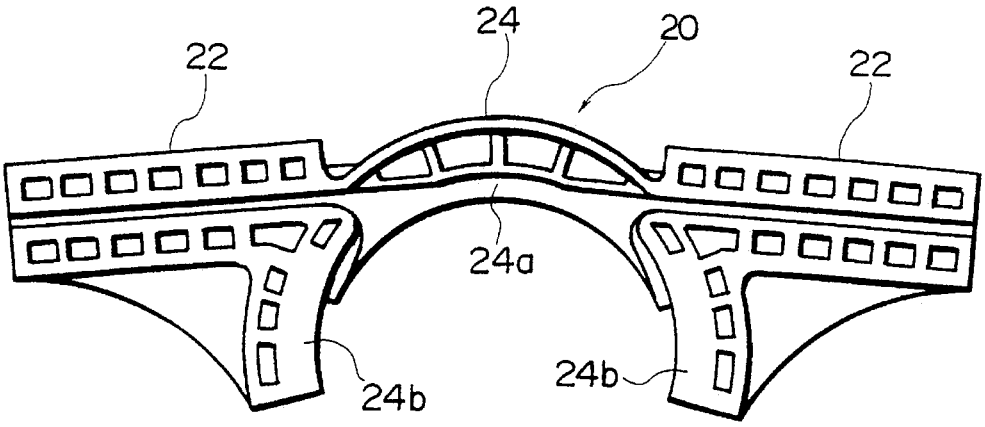
FIGS. 5A–5C show the wire guide of FIGS. 1 and 2.
Figure 5B:
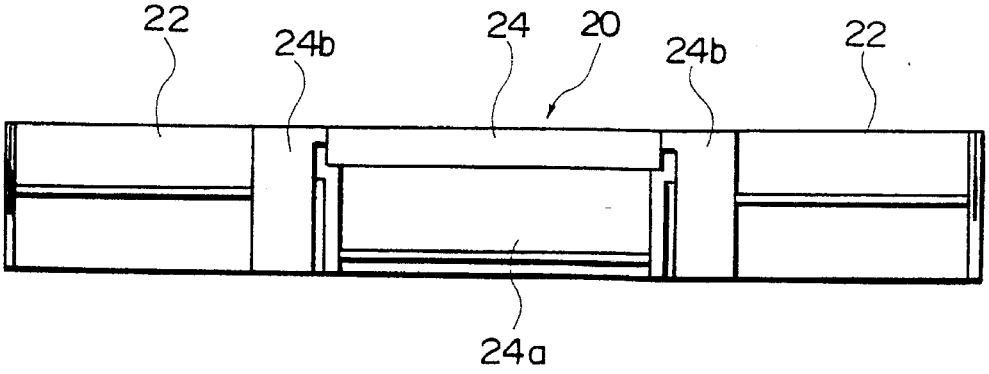
Figure 5C:
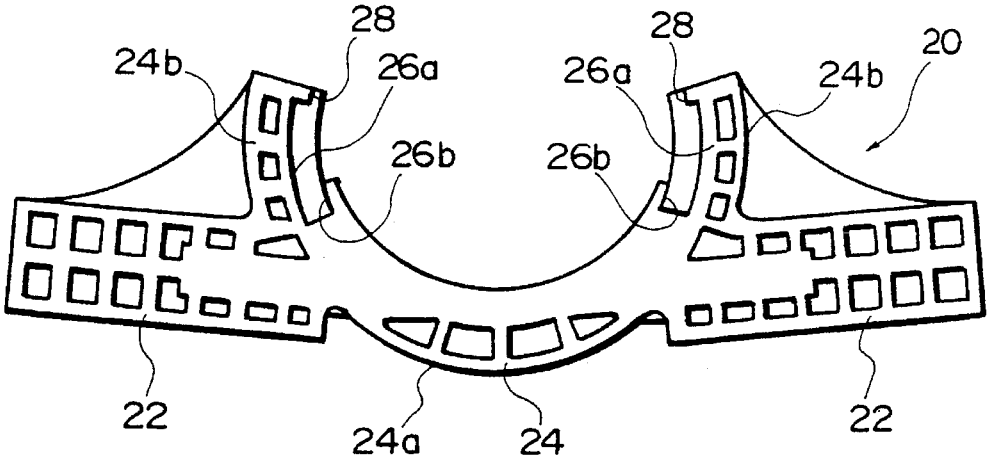

Following is a description of the wire guide 20. FIGS. 5A–5C show the wire guide 20 of FIGS. 1 and 2. FIG. 5A is a plan view from the same direction as FIG. 1, FIG. 5B is a front view, and FIG. 5C is a bottom view.

As indicated in the figures, the wire guide 20 comprises a substantially C-shaped attachment member 24 and square-bar-shaped guide portions 22 extending from the attachment member 24.

The attachment member 24 comprises a curved wall 24*a* and fixing portions 24*b*. The cutout portion 14 of the motor housing 10 is filled with the curved wall 24*a* which forms a cylindrical casing for the take-up drum together with the drum casing wall 12. The limiting wall 16 of the motor housing 10 contacts the outer surface of the curved wall 24*a* and serves to prevent dislodging of the wire guide 20.

Figure 6A:
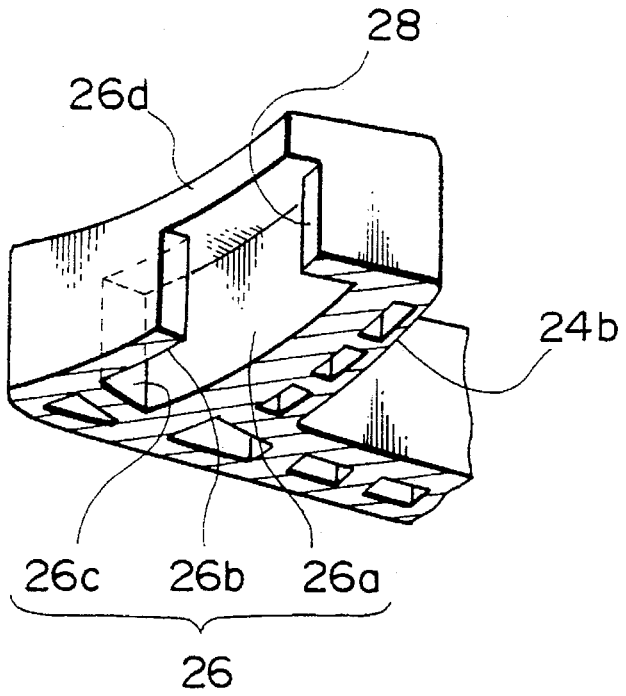
FIGS. 6A and 6B are respectively enlarged perspective views of a part of the attaching portion of the wire guide and a variant.

Each fixing portion 24*b* comprises a contact portion 26 contacting the inner and outer surfaces of the drum casing wall 12 of the motor housing 10, and a protruding or projecting portion 28 which engages with the corresponding steps 12*a*. FIG. 6A is a diagrammatic enlarged perspective view of the fixing portion and FIG. 6B shows an example of a variation thereof.

As indicated in FIG. 6A, the contact portions 26 are formed so as to contact the end parts of the drum casing wall 12. In more detail, as shown in FIG. 6A, each contact portion 26 comprises an outer contact surface 26*a* contacting the outer surface of the drum containment wall 12, an inner contact surface 26*b* contacting the inner surface of the thin wall portion 12*b*, and an end contact surface 26*c* contacting the end surface of the thin wall portion 12*b*. Since these contact surfaces determine the position with respect to the drum containment wall 12, at least either the outer contact surface 26*a* or the inner contact surface 26*b* is necessary, and the others can be omitted.

In addition, a reinforcing portion 26*d*, perpendicular to these outer contact surface 26*a*, inner contact surface 26*b* and end contact surface 26*c*, may be provided in each contact portion 26, thereby preventing deformation of the contact surfaces.

Figure 6B:
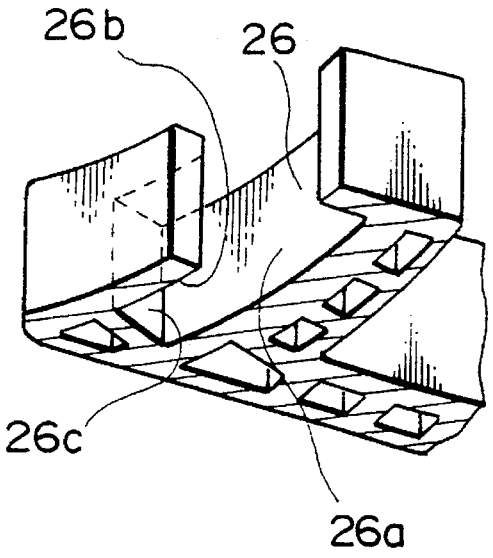

However, when adequate strength is provided by the outer contact surface 26*a*, inner contact surface 26*b* and end contact surface 12*c*, the reinforcing portion 26*d* can be omitted, as shown in FIG. 6B.

The inner contact surface 26*b*, shown diagrammatically in FIGS. 6A and 6B, has a step shape corresponding to the thin wall portion 12*b* and thinner upper part 12*c* shown in FIG. 2.

The protruding portion 28 is provided in each of the fixing portions 24*b*. The protruding portion 28 is formed to protrude in the direction of the wall thickness of the drum casing wall 12 and engages with the corresponding step 12*a* in the drum casing wall 12.

Consequently, when the steps 12*a* are engaged with the protruding portions 28, the wire guide 20 will not move in the circumference direction. As a result, dislodging of the wire guide 20 can be prevented. Moreover, as shown in FIG. 3, since the engaged surfaces form an angle greater than a semicircle, the wire guide 20 is most difficult to dislodge.

Also, by providing the reinforcing portion 26*d*, each protruding portion 28 is rendered difficult to be deformed and strong engaging can be realized.

Figure 9:
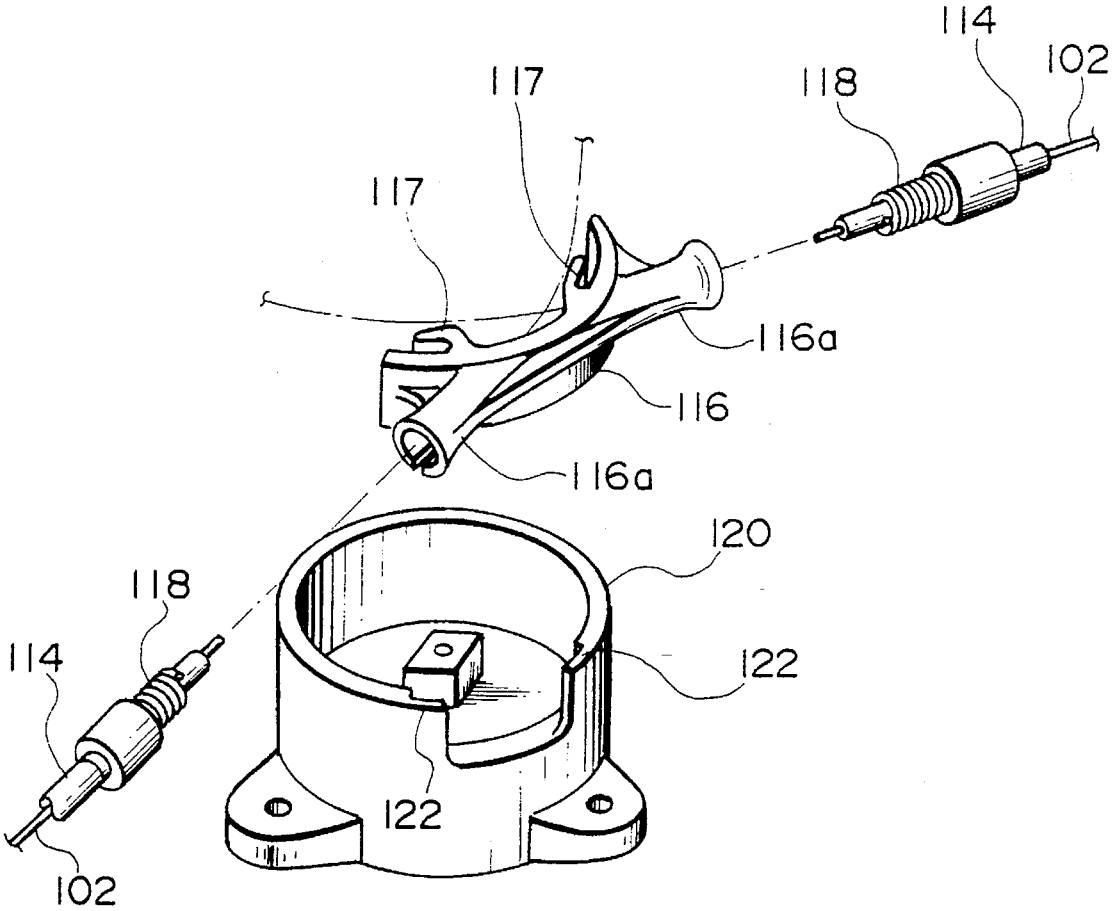
FIG. 9 PRIOR ART
FIG. 9 is an enlarged exploded view of part of FIG. 8.

The wire guide 20 further comprises guide portions 22. Since the guide portions 22 differ in shape from the wire guide portions 116*a* shown in the prior art example of FIGS. 8 and 9 but have the same function, a detailed description is omitted below.

Figure 7:
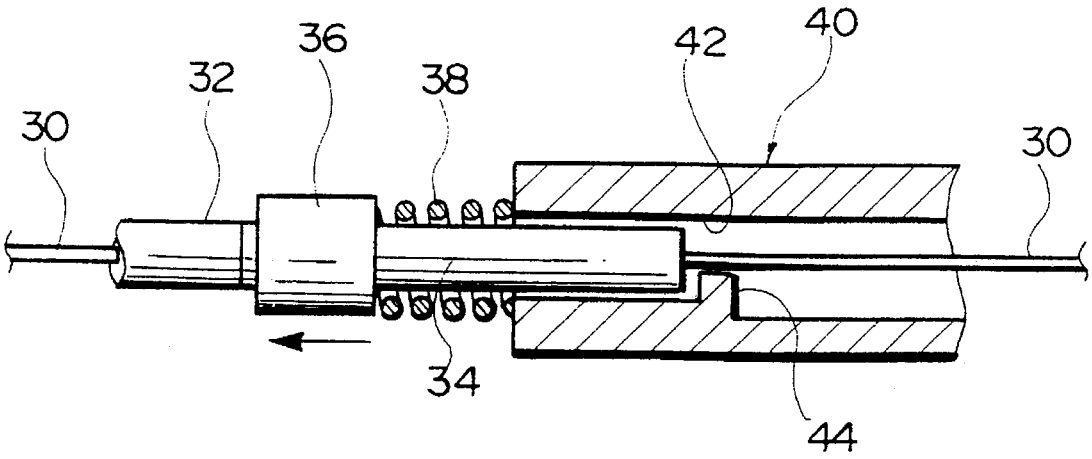
FIG. 7 shows a guide portion of the embodiment.

FIG. 7 shows a modified wire guide. In FIG. 7, an endless wire 30 passes through a tube 32. An insert portion 34 to be guided by the guide portion 40 is provided at the end of the tube 32. To be more precise, the insert portion 34 is provided via a conventional adjustment portion 36 enabling to adjust the length of the tube 32.

The guide portion 40 comprises a guide hole 42 through which the insert portion 34 is inserted. A stopper 44 is disposed in the guide hole 42 and prevents the insert portion 34 from being inserted beyond a predetermined length.

The insert portion 34 is inserted equally through a spring 38. The spring 38 is compressed between the end of the guide portion 40 and the adjustment portion 36. Consequently, the tube 32 is pressed by the spring 38 in the releasing direction from the guide portion 40. The stopper 44 regulates compression amount and protects the spring 38.

In FIG. 7, the spring 38 is exposed outward and presses the tube 32. The result obtained from this pressing is the same as the above mentioned related art and the description is omitted below.

As described above, as a result of this embodiment, the wire guide is difficult to dislodge. Consequently, by increasing the angle between one guide portion and the other guide portion, the angle at which the endless wire is delivered can be made larger, while the conventional wire guide is likely to dislodge-when the angle between the guide portions is large.

In addition, contrary to the conventional art, the length of the guide portions can be increased, so the length of the tubes to be inserted into the guide portions can be also increased. As a result, the adjustable length of the endless wire is increased. Further, a spring used in this case is also long.

What is claimed is:

1. A wire type window regulator wherein a window glass supporting member secured to an endless wire is moved by taking up said endless wire with a take-up drum which turns in response to rotation of a motor, comprising:

a drum casing wall which has a substantially cylindrical shape, a cutout portion, and is formed in a motor housing internally containing said take-up drum;

a wire guide having an attachment member which fills said cutout portion in said drum casing wall and contacts an inner surface of said drum casing wall to be attached to said motor housing, and guide portions which extend from said attachment member and guide inward and outward movement of said endless wire;

at least one depressed portion provided in a direction of wall thickness of said drum casing wall at said inner surface which contacts said attachment member of said wire guide; and at least one projecting portion provided in said attachment member of said wire guide and engaging with said depressed portion.

2. The wire type window regulator as defined in claim 1, wherein said at least one depressed portion comprises a pair of depressed portions provided at both ends of said cutout portion in said drum casing wall to have an angle greater than a semicircle on the side of said cutout portion, contours of said drum casing wall form a circle, a center point of said circle and said depressed portions describe an angle on the side of said cutout portion, and said angle is greater than $\pi$ radians.

3. The wire type window regulator as defined in claim 2 and further comprising:

a limiting wall disposed at the outside of said cutout portion of said drum casing wall in said motor housing for preventing dislodging of said wire guide from said drum casing wall.

4. The wire type window regulator as defined in claim 1 and further comprising:

a limiting wall disposed at the outside of said cutout portion of said drum casing wall in said motor housing for preventing dislodging of said wire guide from said drum casing wall.

5. A wire type window regulator wherein a window glass supporting member secured to an endless wire is moved by taking up said endless wire with a take-up drum which turns in response to rotation of a motor, comprising:

a drum casing wall which has a substantially cylindrical shape and a cutout portion and is formed in a motor housing internally containing said take-up drum;

a wire guide having an attachment member which fills said cutout portion in said drum casing wall and contacts an outer surface of said drum casing wall to be attached to said motor housing, and guide portions which extend from said attachment member and guide inward and outward movement of said endless wire;

at least one depressed portion provided in a direction of wall thickness of said drum casing wall at said outer surface which contacts said attachment member of said wire guide; and at least one projecting portion provided in said attachment member of said wire guide and engaging with said depressed portion.

6. The wire type window regulator as defined in claim 5, wherein said at least one depressed portion comprises one pair of depressed provided at both ends of said cutout portion in said drum casing wall to have an angle greater than a semicircle on the said cutout portion, contours of said drum casing wall form a circle, a center portion of said circle and said depressed portions describe an angle on the side of said cutout portion, and said angle is greater than π radians.

7. The wire type window regulator as defined in claim 6 wherein said limiting wall is disposed outside of said cutout portion of said drum casing wall in said motor housing, said limiting wall preventing dislodging of said wire guide from said drum casing wall.

8. The wire type window regulator as defined in claim 5 which comprises:

a limiting wall disposed outside of said cutout portion of said drum casing wall in said motor housing, said limiting wall preventing dislodging of said wire guide from said drum casing wall.

9. A wire type window regulator wherein a window glass supporting member secured to an endless wire is moved by taking up said endless wire with a take-up drum which turns in response to rotation of a motor, comprising:

a drum casing wall which has a substantially cylindrical shape, a cutout portion, and is formed in a motor housing for internally containing said take-up drum;

a wire guide having an attachment member which fills said cutout portion in said drum casing wall and contacts both an inner surface and an outer surface of said drum casing wall to be attached to said motor housing, and guide portions which extend from said attachment member and guide inward and outward movement of said endless wire;

at least one depressed portion provided in a direction of wall thickness of said drum casing wall at each of said inner surface and said outer surface which contact said attachment member of said wire guide; and at least one projecting portion provided in said attachment member of said wire guide to engage with said depressed portion.

10. The wire type window regulator as defined in claim 9, wherein one pair of said depressed portions are provided at each of said inner surface and said outer surface of said drum casing wall, contours of said drum casing wall describing a circle, a center portion of said circle and said depressed portions describe an angle on the side of said cutout portion, said angle is greater than π radians.

11. The wire type window regulator as defined in claim 10 which comprises:

a limiting wall disposed outside of said cutout portion of said drum casing wall in said motor housing, said limiting wall preventing dislodging of said wire guide from said drum casing wall.

12. The wire type window regulator as defined in claim 9 which comprises:

a limiting wall disposed outside of said cutout portion of said drum casing wall in said motor housing, said limiting wall preventing dislodging of said wire guide from said drum casing wall.

13. A wire type window regulator wherein a window glass supporting member secured to an endless wire is moved by taking up said endless wire with a take-up drum which turns in response to rotation of a motor, comprising:

a drum casing wall which has a substantially cylindrical shape, a cutout portion, and is formed in a motor housing internally containing said take-up drum;

a wire guide having an attachment member which fills said cutout portion in said drum casing wall and contacts an inner surface of said drum casing wall to be attached to said motor housing, and guide portions which extend from said attachment member and guide inward and outward movement of said endless wire;

at least one engaging portion provided in a direction of wall thickness of said drum casing wall at said inner surface which contacts said attachment member of said wire guide;

at least one receiving portion provided in said attachment member of said wire guide to engage with said engaging portion; and a limiting wall disposed outside of said cutout portion of said drum casing wall in said motor housing and preventing dislodging of said wire guide from said drum casing wall.

14. A wire type window regulator wherein a window glass supporting member secured to an endless wire is moved by taking up said endless wire with a take-up drum which turns in response to rotation of a motor, comprising:

a drum casing wall which has a substantially cylindrical shape, a cutout portion, and is formed in a motor housing internally containing said take-up drum;

a wire guide having an attachment member which fills said cutout portion in said drum casing wall and contacts an inner surface of said drum casing wall to be attached to said motor housing, and guide portions which extend from said attachment member and guide inward and outward movement of said endless wire;

one pair of engaging portions provided in a direction of wall thickness of said drum casing wall at said inner surface which contacts said attachment member of said wire guide, contours of said drum casing wall describing a circle, a center portion of said circle and said engaging portions describing an angle on the side of said cutout portion, and said angle being greater than π radians;

one pair of receiving portions provided in said attachment member of said wire guide, said receiving portions engaging with said engaging portions; and a limiting wall disposed at the outside of said cutout portion of said drum casing wall in said motor housing and preventing dislodging of said wire guide from said drum casing wall.

15. A wire type window regulator wherein a window glass supporting member secured to an endless wire is moved by taking up said endless wire with a take-up drum which turns in response to rotation of a motor, comprising:

a drum casing wall which has a substantially cylindrical shape, a cutout portion, and is formed in a motor housing internally containing said take-up drum;

a wire guide comprising an attachment member which fills said cutout portion in said drum casing wall and contacts an outer surface of said drum casing wall to be attached to said motor housing, and guide portions which extend from said attachment member and guide inward and outward movement of said endless wire;

at least one engaging portion provided in a direction of wall thickness of said drum casing wall at said outer surface which contacts said attachment member of said wire guide;

at least one receiving portion provided in said attachment member of said wire guide, said receiving portion engaging with said engaging portion; and a limiting wall disposed outside of said cutout portion of said drum casing wall in said motor housing and preventing dislodging of said wire guide from said drum casing wall.

16. A wire type window regulator wherein a window glass supporting member secured to an endless wire is moved by taking up said endless wire with a take-up drum which turns in response to rotation of a motor, comprising:

a drum casing wall which has a substantially cylindrical shape, a cutout portion, and is formed in a motor housing internally containing said take-up drum;

a wire guide comprising an attachment member which fills said cutout portion in said drum casing wall and contacts an outer surface of said drum casing wall to be attached to said motor housing, and guide portions-which extend from said attachment member and guide inward and outward movement of said endless wire;

one pair of engaging portions provided in a direction of wall thickness of said drum casing wall at said outer surface which contacts said attachment member of said wire guide, contours of said drum casing wall describing a circle, a center point of said circle and said engaging portions describing an angle on the side of said cutout portion, and said angle being greater than $\pi$ radians;

one pair of receiving portions provided in said attachment member of said wire guide, said receiving portions engaging with said engaging portions; and a limiting wall disposed outside of said cutout portion of said drum casing wall in said motor housing and preventing dislodging of said wire guide from said drum casing wall.

17. A wire type window regulator wherein a window glass supporting member secured to an endless wire is moved by taking up said endless wire with a take-up drum which turns in response to rotation of a motor, comprising:

a drum casing wall which has a substantially cylindrical shape, a cutout portion, and is formed in a motor housing internally containing said take-up drum;

a wire guide comprising an attachment member which fills said cutout portion in said drum casing wall and contacts both an inner surface and an outer surface of said drum casing wall to be attached to said motor housing, and guide portions which extend from said attachment member and guide inward and outward movement of said endless wire;

at least one engaging portion provided in a direction of wall thickness of said drum casing wall at each of said inner surface and said outer surface which contact said attachment member of said wire guide;

at least one receiving portion provided in aid attachment member of said wire guide, said receiving portion engaging with said engaging portion; and a limiting wall disposed outside of said cutout portion of said drum casing wall in said motor housing and preventing dislodging of said wire guide from said drum casing wall.

18. A wire type window regulator wherein a window glass supporting member secured to an endless wire is moved by taking up said endless wire with a take-up drum which turns in response to rotation of a motor, comprising:

a drum casing wall which has-a substantially cylindrical shape, a cutout portion, and is formed in a motor housing internally containing said take-up drum;

a wire guide comprising an attachment member which fills said cutout portion in said drum casing wall and contacts both an inner surface and an outer surface of said drum casing wall to be attached to said motor housing, and guide portions which extend from said attachment member and guide inward and outward movement of said endless wire;

one pair of engaging portions provided in a direction of wall thickness of said drum casing wall at each of said inner surface and said outer surface which contact said attachment member of said wire guide, contours of said drum casing all describing a circle, a center point of said circle and said engaging portions describing an angle on the side of said cutout portion, and said angle being greater than $\pi$ radians;

one pair of receiving portions provided in said attachment member of said wire guide, said receiving portions engaging with said engaging portion; and a limiting wall disposed outside of said cutout portion of said drum casing wall in said motor housing and preventing dislodging of said wire guide from said drum casing wall.

* * * * *